United States Patent [19]

Winslow

[11] 3,971,525

[45] July 27, 1976

[54] SEMI-AUTOMATIC HANKING APPARATUS

[75] Inventor: Arthur Winslow, Fairfield, Conn.

[73] Assignee: Stanley L. Mead, Portland, Oreg.

[22] Filed: Jan. 8, 1975

[21] Appl. No.: 539,394

[52] U.S. Cl. ..... 242/110

[51] Int. Cl.[2] ..... B65H 75/24

[58] Field of Search ..... 242/53, 110, 110.3; 226/118, 119

[56] References Cited

UNITED STATES PATENTS

| | | | |
|---|---|---|---|
| 3,473,747 | 10/1969 | Takai et al. | 242/53 |
| 3,480,219 | 11/1969 | Hanscom | 242/53 |

*Primary Examiner*—Leonard D. Christian

*Attorney, Agent, or Firm*—Chernoff & Vilhauer

[57] ABSTRACT

An apparatus for forming a length of elongate flexible material into a hank containing a selectable number of loops. The material is wrapped around a pair of post members which are mounted on a rotatable base member which in turn is drivingly connectable to a continuously-running electric motor via an electronically-controlled clutch and brake assembly. When the clutch is engaged the brake is released, thereby permitting the base member to be rotated by the motor, and when the clutch is released the brake is engaged, thereby accurately stopping the base member at a predetermined angular position. The electronic control circuitry activates the clutch and releases the brake when an operator depresses a foot switch, and releases the clutch and activates the brake upon receiving a predetermined number of signals representing revolutions of the rotating base member from a magnetic sensor positioned proximate the base member and responsive to the passage therepast of a ferrite element mounted on the base member. Operator-adjustable controls associated with the electronic control circuitry permit the base member to be stopped after any predetermined number of revolutions and at different predetermined angular positions. To facilitate the withdrawal of the finished hank after the base member has been stopped, the two posts around which the hank is wrapped are movable laterally toward each other, but are spring-biased to return to their respective outward-spaced position.

3 Claims, 6 Drawing Figures

SEMI-AUTOMATIC HANKING APPARATUS

BACKGROUND OF THE INVENTION

The present invention is directed to improvements in apparatus for semi-automatically forming a length of elongate flexible material into hanks. To facilitate packaging and handling, certain types of elongate flexible material, such as electrical power cords or the like, are commonly formed into hanks comprising a series of elongated loops that are gathered at their centers and tied by one or more wraps of wire tape or other tying means.

Individual machines have been developed to form the elongate material into hanks and to tie the hanks about their centers with wire tape. However, until this time, a hanking machine has not been developed that is capable of interfacing with a tying machine such that the elongate flexible material can be formed into hanks and thereafter tied without requiring an intermediate manual operation such as removing the hanked material from the hanking machine and presenting it to the tying machine.

The barrier to this union of the hanking machine with the tying machine has been the inability of known hanking machines to accurately and repeatedly place the finished hank of elongate material in a predetermined position where it could be automatically engaged and tied by the tying machine. Known prior art hanking machines comprise a pair of post members attached to and extending vertically upward from a horizontally rotatable disc. In operation, one end of a length of elongate material is removably attached to the base of one of the posts and an operator-controlled foot switch or other activating means is operated, causing the disc to rotate. As the disc rotates, the remaining length of elongate material will be wrapped around the two revolving posts until the operator releases the foot switch, at which time the disc is brought to a stop.

The major problems with this prior art type of hanking machine are that the rotating disc will revolve as long as the foot switch is depressed, which is often longer than the time necessary to form the hank, and once the foot switch is released, the disc will stop in a random position determined by its position at the time of release of the foot switch and the stopping distance for the disc. As the point at which the foot switch is released by the operator is variable, being dependent upon the point at which the operator recognizes that the entire length of elongate material has been hanked, the angular position of the disc when it stops, and thus each hank formed thereupon, cannot be accurately predicted. Thus, in prior art machines the hank cannot be consistently presented to a tying machine or other subsequent handling apparatus in a predictable angular position, such as horizontal for example, without an operator manually removing the hank from the hanking machine and presenting it to the machine oriented in the proper attitude.

In addition, the means employed in prior art hanking machines to stop the rotating disc includes a mechanical switch attached to the disc and operated by centrifugal force. Once the foot switch is released a clutch or other means connecting the disc to a source of rotational energy is disengaged and the speed of the rotating disc begins to decrease slightly, permitting the centrifugal switch to operate and thereby cause the rotating disc to be brought to a halt by energizing a brake or other stopping means. It is impossible to predict with any degree of accuracy the length of time after the foot switch is released until the disc will slow down an amount sufficient to permit the centrifugal switch to operate. This unpredictability of the point of operation of the centrifugal switch, coupled with the operator's random release of the foot switch, practically ensures that the disc will stop each time at a different, and unpredetermined position. Moreover, as the stopping of the disc is controlled by a mechanical, centrifugally-operated switch mounted on the disc itself, the disc is limited to rotation in a horizontal plane. Operation of the disc in any other plane would introduce the effects of gravity upon the centrifugally-operated switch, thereby interfering with its intended mode of operation.

SUMMARY OF THE INVENTION

The present invention is directed to an apparatus for forming a length of elongate flexible material into a hank containing a predetermined number of loops and then placing the finished hank in a predetermined position permitting it to be automatically presented to a tying machine or other subsequent handling apparatus. More particularly, the apparatus of the present invention comprises a pair of mutually-parallel, laterally-spaced posts protruding normally from the face of a rotatable disc which may be automatically rotated through a predetermined number of revolutions and then stopped with the two posts positioned at a predetermined orientation. The posts and the disc are constructed of non-ferrous material permitting the presence of a small ferromagnetic tab attached to the underside of the rotatable disc near its periphery to be detected by a magnetic-type pick-up device mounted on the frame supporting the apparatus. Each time the ferromagnetic tab passes the pick-up device, an electrical signal is transmitted by the device to a monitor control circuit that controls the action of a clutch and brake assembly which is operatively engageable with a continuously-operating electric motor drive for the rotatable disc.

When the monitor circuit is activated, such as by an operator depressing a foot switch, the brake, which normally holds the disc in a fixed angular position, is released and the clutch is engaged, causing the disc to be rotated by the electric motor. On each revolution the passage of the ferromagnetic tab mounted on the disc is detected by the pick-up device and a signal sent to the monitor circuit. When a settable counter in the monitor has received a predetermined number of signals from the pick-up device, the clutch is released and the brake simultaneously engaged, thereby slowing the disc and causing it to stop with the two posts thereon positioned at a specific predetermined angular orientation.

To form an elongate flexible material, for example, a long length of electric power cord, into a hank, one end of the cord is first attached to one of the posts by engagement with a slot provided for that purpose near the base of the post, and counter controls on the monitor are manually set for the desired number of disc revolutions. The operator foot switch is then depressed, simultaneously releasing the brake and energizing the clutch, thereby causing the disc to be coupled to the continuously-running motor and begin rotating. As the disc rotates, reeling in the power cord and looping it into a hank around the two revolving posts, the pick-up device will detect the passage of the ferromagnetic tab and the monitor counter circuit will compare the total accumulated signals from the pick-up device against the number of desired revolutions as preset in its counter. When the preset count is reached, the monitor circuit will simultaneously cause the clutch to disengage and the brake to engage, thereby stopping the disc with the two posts holding the hanked power cord in a predetermined fixed position.

A second control in the monitor circuit is used by the operator to adjust the torque of the brake which in turn determines how far the disc will rotate, after the brake is engaged, until it reaches a stopping position. The monitor circuit and brake assembly employed in the present invention are sufficiently accurate to repeatedly stop the disc, and thereby hold the hanked material, within one degree of a preselected angular position. This accurate positioning of the hanked material permits the hanking apparatus to be successfully interfaced with a subsequent apparatus, for example, a tying machine, which requires that the hank be presented to it oriented in a certain angular attitude.

By adjustment of the torque control, of the monitor, the disc may be accurately stopped at any point within a narrow angular range. For those applications where a wider range of stopping positions is necessary, or desired, additional ferromagnetic tabs may be mounted near the underside periphery of the disc, and the monitor counter and torque controls set accordingly.

The operation of the clutch and brake assembly under the electronic control of the monitor control circuit, whereby the disc is rotated automatically through a predetermined number of revolutions and then stopped automatically at a predetermined angular position, rather than rotating continuously until the operator releases the foot switch and then being stopped through the action of a mechanical centrifugal switch attached to the rotating disc, permits the elongated flexible material to be formed into hanks containing a predetermined number of loops and, more importantly, permits the rotating disc and its protruding hanking posts to be operated in any desired positional attitude. This latter feature, by itself, provides a distinct improvement over the known prior art hanking devices which by their nature are inherently restricted to a horizontal plane of rotation.

The two posts protruding from the face of the disc are movable, outwardly from the face of the disc and laterally toward the axis of rotation thereof, to facilitate removal of the hank wrapped therearound once the disc has been stopped. A biasing spring within each post returns the posts to their original position after the hank has been removed.

It is, therefore, a principal objective of the present invention to provide a semi-automatic hanking apparatus capable of forming a length of elongate flexible material into a hank containing a selectable number of loops and thereafter presenting said hank oriented in a predetermined angular position so that the hank may be readily and automatically operated upon by subsequent handling or processing apparatus.

It is a principal feature of the hanking apparatus of the present invention that it will form a length of elongate flexible material into a hank containing a predetermined number of loops.

It is an additional principal feature of the hanking apparatus of the present invention that the rotatable disc upon which the hanking posts are mounted may be operated in any positional attitude and not restricted to a horizontal plane of revolution.

The foregoing objectives, features and advantages of the present invention will be more readily understood upon consideration of the following detailed description of the invention taken in conjunction with the accompanying drawings.

DETAILED DESCRIPTION OF THE PREFERRED EMBODIMENT

Figure 1:
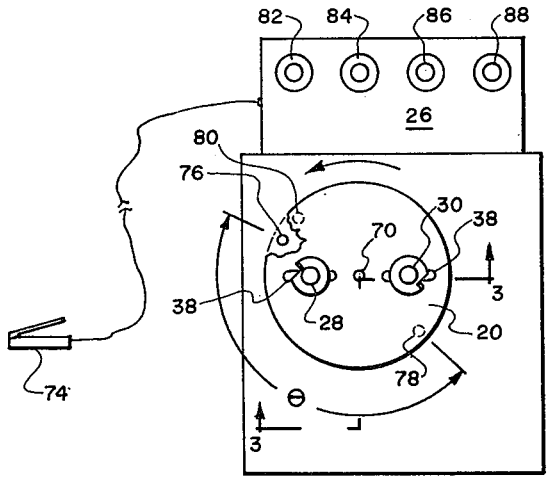
FIG. 1 is a front elevation of the hanking apparatus of the present invention.
Figure 2:
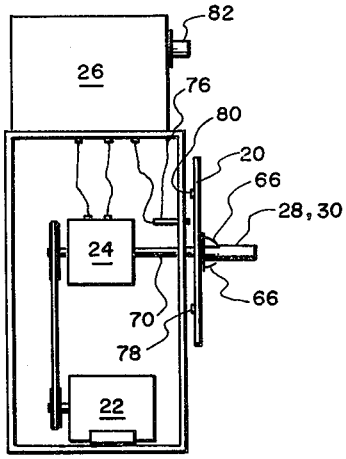
FIG. 2 is a side elevation of the hanking apparatus of FIG. 1.
Figure 3:
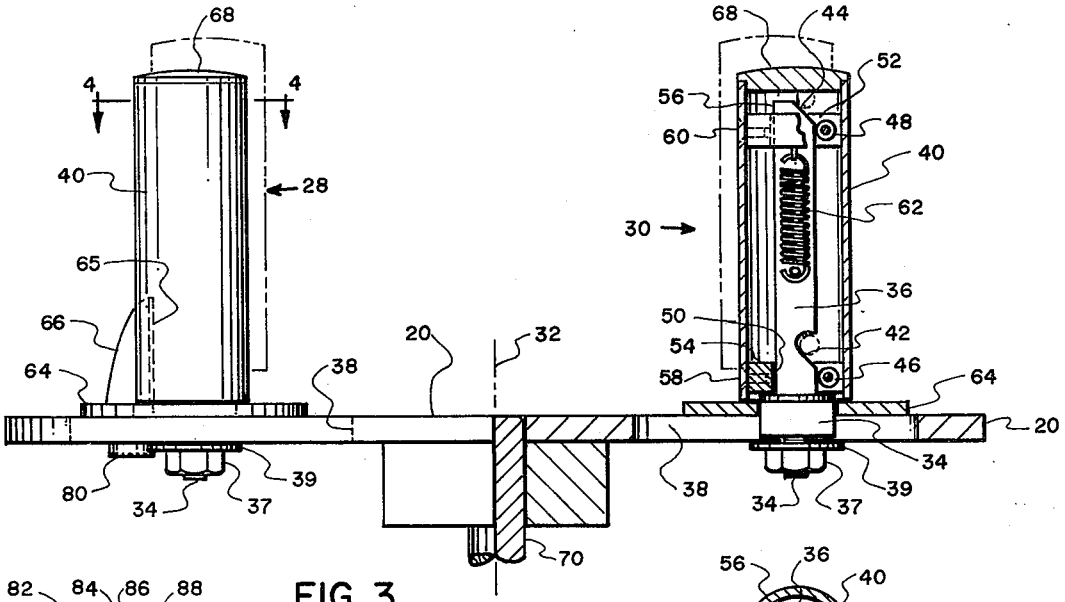
FIG. 3 is a partially-sectional elevation view of the rotatable base and post members of the hanking apparatus taken along line 3—3 of FIG. 1.

Referring to FIGS. 1, 2 and 3, the preferred embodiment of the hanking apparatus of the present invention is seen to comprise a rotatable base member 20 operationally coupled to an electric motor 22 via a clutch and brake assembly 24 controlled by an electronic monitor 26. Mounted on the disc-shaped base member 20 are two mutually-parallel, laterally-spaced post members 28 and 30, best seen in FIG. 3, each of which is positioned substantially equidistant from a line 32 through the center of the disc. Attachment of the post members to the base member is accomplished by inserting a threaded base portion 34 of a post support member 36 located within each post member through an elongate slot 38 formed in either side of the base member and securing the post support member with a nut 37 and washer 39. The use of an elongate slot in the base member permits the post members to be individually adjusted relative to line 32 through the center of the base member.

Figure 4:
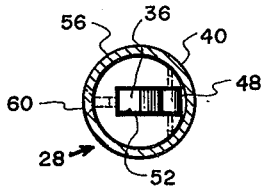
FIG. 4 is a detail sectional view taken along line 4—4 of FIG. 3.

Post members 28 and 30 are of identical construction, each comprising a cylindrical outer shell 40 movably mounted over an elongate support member 36. As best seen in FIGS. 3 and 4, one edge of the post support member 36 includes a slanted notch 42 near its base and a similarly slanted edge portion 44 at its top. Two rollers 46 and 48, mounted in the elongate slots 50 and 52 formed in post cross-members 54 and 56 respectively, may be moved along the edge of post support member 36, deflecting laterally at notch 42 and the slanted edge portion 44 of the post support member, thereby permitting the post shell 40, attached to the cross-members by screws 58 and 60 respectively, to be displaced longitudinally and laterally. A biasing spring 62 attached to the post support member and to the upper cross-member 56 provides a biasing force to return the displaced post member to its original position once the displacing force has been removed.

A flat circular washer 64 having an upturned segment 66 is mounted between the post support member and the base member to facilitate the engagement of one end of a length of elongate flexible material as described below. Cap member 68, press fitted into the top of post shell 40, completes the assembly.

Referring again to FIGS. 1 and 2, base member 20 is seen to be attached to the drive shaft 70 of the clutch/-brake assembly 24 which in turn is coupled via a pulley and belt to the electric motor 22. During operation of the apparatus, the electric motor 22 runs continuously such that, when the clutch of the clutch/brake assembly is engaged, shaft 70, and therefore base member 20, will be rotated in the direction indicated by the arrow in FIG. 1. The clutch and brake components of the clutch/brake assembly 24 operate alternately such that whenever the clutch is engaged to couple the motor to the base member the brake is disengaged and whenever the clutch is disengaged the brake is engaged to bring the base member to a halt. The electronic monitor control circuit 26 controlling the action of the clutch/-brake assembly 24 is activated by depressing foot switch 74 and also receives an input signal from a magnetic-type pick-up device 76 fixedly attached to the apparatus frame proximate the underside periphery of base member 20.

A suitable clutch/brake assembly is the Warner Electro-Pack 400 and a suitable monitor control circuit is the Warner MCS-709 Control equipped with two MCS-707 counter modules, an MCS-709 impulse amplifier module, an MCS-710 torque adjustment module and an MCS-601 magnetic pick-up, all of which are manufactured by the Warner Electric Brake and Clutch Company of Beloit, Wis. The operation of the various modules is described below.

Attached to the undersurface of base member 20 near its periphery are a plurality of small tabs of ferromagnetic material, two of which 78 and 80 are shown in the figures. As base member 20 is rotated, causing the ferromagnetic tabs to pass near pick-up 76, a magnetic field generated around the pick-up will be disturbed and a resultant signal will be transmitted from the pick-up device to the monitor control circuit 26. This signal will be generated by the pick-up device each time a ferromagnetic tab passes by.

Figure 5:
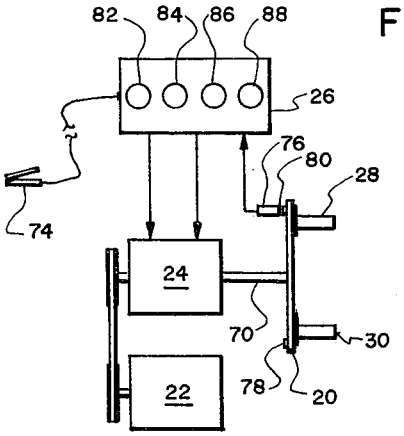
FIG. 5 is a schematic diagram of an exemplary control system for the apparatus of the present invention.

The operation of the hanking apparatus of the present invention is best described with reference to the control diagram of FIG. 5. Monitor control 26 includes a plurality of operator set control knobs 82 through 88, two of which 84 and 86 control a counter module within the monitor. With these two controls pre-set to a value from 01 to 99 and foot switch 74 depressed, the monitor 26 will cause the clutch of the clutch/brake assembly 24 to be engaged and the brake to be disengaged, thereby transferring rotational energy from the continuously-running motor 22 to shaft 70 and base member 20. The rotation of the base member will carry the ferromagnetic tabs 78 and 80 past the pick-up device 76 causing the pick-up to transmit a series of signals to the monitor. The sum of these signals is continuously compared by the monitor with the counter value previously set by the operator via control knobs 84 and 86 and when the sum is equal to the counter value, monitor 26 will cause the clutch of the clutch/brake assembly 24 to be disengaged and the brake to be engaged, thereby effectively decoupling base member 20 from motor 22 and bringing the base member to a stop.

The distance that the base member will travel after the brake is engaged is indicated in FIG. 1 by the angular displacement theta between ferromagnetic tab 78 and the pick-up 76. By adjusting a torque adjust control knob 88 connected to a torque adjustment module within the monitor 26, the torque of the brake may be varied, thereby permitting base member 20 to be brought to a halt with a preset angular displacement between ferromagnetic tab 78 and pick-up 76 larger or smaller than that shown in FIG. 1. However, it is crucial that, once the brake torque is adjusted, the monitor control circuit and the clutch/brake assembly employed must be able to bring base member 20 to a halt repeatedly and accurately with a fixed angular displacement between the ferromagnetic tab and the pick-up device.

The fourth control knob 82 of monitor 26 adjusts an impulse amplifier module through which the signal generated by the pick-up is processed and may be adjusted for various sizes and shapes of ferromagnetic tabs. More than one ferromagnetic tab may be attached to base member 20, thereby permitting the base member to be stopped after rotating through less than an integral number of complete revolutions. For example, with the two ferromagnetic tabs shown in the figures, the base member may be brought to a halt after rotating through a multiple of one-half revolutions. With three tabs, the base member could be brought to a halt after rotating through a multiple of one-third revolutions. After the base member has been halted, the procedure may be repeated by re-depressing foot switch 74.

Figure 6:
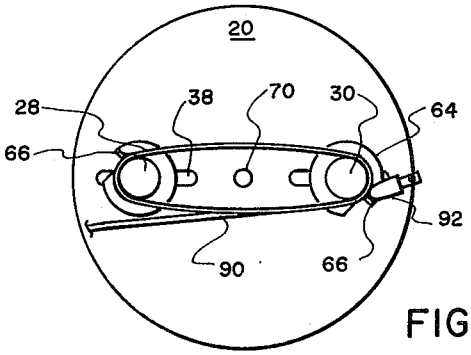
FIG. 6 is a plan view of the rotatable base and post members of the hanking apparatus of the present invention.

In operation to form a length of elongate flexible material into a hank containing a predetermined number of loops, the apparatus is adjusted as described above and one end of the elongate material, shown as an electric power cord 90 in FIG. 6, is attached near the base of one of the post members by engaging one end of the cord, for example, the end with the plug 92, in the slot formed between edge 65 of the upturned segment 66 of washer 64 and the outer surface of the post member. Foot switch 74 is then momentarily depressed, causing the base member to rotate, winding the cord around the two revolving post members and coming to a halt with the hank thus formed positioned in a predetermined attitude, for example, with its loops extending horizontally as shown in the figure. With the base member stopped, the center portion of the hank between the two post members may be grasped and pulled in a direction normal to the face of the base member. As the hank is pulled, the two post members will be moved outwardly and laterally, as shown in FIG. 3, thereby permitting the hank to be readily withdrawn. Once the hank is removed, spring 62 within each of the post members will return the post members to their original positions.

As the braking of the rotatable base member 20 is controlled by an electronic monitor, rather than by an operator releasing a foot switch and the subsequent action of a centrifugally-operated switch attached to the base member, the apparatus may be constructed with the plane of rotation of the base member oriented at any angle, for example, at an angle required to interface the hanking apparatus with an apparatus for automatically removing the hank from the post members or performing some other subsequent operation on the hank without the need for manual intervention.

The terms and expressions which have been employed in the foregoing abstract and specification are used therein as terms of description and not of limitation, and there is no intention, in the use of such terms and expressions of excluding equivalents of the features shown and described or portions thereof, it being recognized that the scope of the invention is defined and limited only by the claims which follow.

What is claimed is:

1. An apparatus for forming a length of elongate flexible material into a hank containing a predetermined number of loops comprising:

a. a rotatable base member;

b. hanking means attached to said base member for loopingly engaging a length of elongate flexible material as said base member is rotated;

c. means for rotating said base member including an electric motor drive and selectively engagable clutch means for operatively connecting said motor drive to said base member;

d. detector means for producing an electric signal pulse upon each revolution of said base member, and a control circuit, responsive to said signal pulses and including counter means, for maintaining said clutch means engaged with said motor drive until the sum of said signal pulses equals a value preset in said counter means; and e. means for consistently stopping said base member in a predetermined angular position after it has traversed a number of revolutions corresponding to said preset value in said counter means.

2. An apparatus for forming a length of elongate flexible material into a hank containing a predetermined number of loops comprising:

a. a rotatable base member having a ferromagnetic element at a localized region thereon;

b. hanking means attached to said base member for loopingly engaging a length of elongate flexible material as said base member is rotated;

c. means for rotating said base member including an electric motor drive and selectively engagable clutch means for operatively connecting said motor drive to said base member;

d. means for consistently stopping said base member in a predetermined angular position after it has traversed said predetermined number of revolutions, said stopping means including brake means selectively engagable with said base member; and e. detector means for producing an electric signal pulse upon each revolution of said base number, said detector means including a magnetic pickup fixedly positioned proximate the path of said ferromagnetic element on said base member, and a control circuit, responsive to said signal pulses and including counter means, for maintaining said clutch means engaged with said motor drive, said control circuit operating to simultaneously release said clutch means and engage said brake means when the sum of said signal pulses from said detector means is equal to a value preset in said counter means.

3. The apparatus of claim 2 wherein said control circuit includes means for adjusting the torque setting of said brake means so as to provide a range of adjustment in the angular distance which said base member will travel after the engagement of said brake means.

* * * * *

UNITED STATES PATENT AND TRADEMARK OFFICE

CERTIFICATE OF CORRECTION

PATENT NO. : 3,971,525

DATED : July 27, 1976

INVENTOR(S) : Arthur Winslow

It is certified that error appears in the above-identified patent and that said Letters Patent are hereby corrected as shown below:

Col. 1, Line 51 After "thus" insert the word --of--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*